US007240895B2

(12) United States Patent
Abele et al.

(10) Patent No.: US 7,240,895 B2
(45) Date of Patent: Jul. 10, 2007

(54) GAS EXCHANGE VALVE FOR AN INTERNAL COMBUSTION ENGINE

(75) Inventors: Marcus Abele, Gerlingen (DE); Martin Lechner, Stuttgart (DE)

(73) Assignee: Mahle Ventiltrieb GmbH, Stuttgart (DE)

( * ) Notice: Subject to any disclaimer, the term of this patent is extended or adjusted under 35 U.S.C. 154(b) by 64 days.

(21) Appl. No.: 10/556,967

(22) PCT Filed: Feb. 4, 2005

(86) PCT No.: PCT/DE2005/000179

§ 371 (c)(1),
(2), (4) Date: Nov. 16, 2005

(87) PCT Pub. No.: WO2005/085605

PCT Pub. Date: Sep. 15, 2005

(65) Prior Publication Data

US 2007/0040144 A1 Feb. 22, 2007

(30) Foreign Application Priority Data

Mar. 3, 2004 (DE) ..... 10 2004 010 309

(51) Int. Cl.
*F01L 3/20* (2006.01)

(52) U.S. Cl. ..... 251/356; 123/188.3

(58) Field of Classification Search ..... 251/356, 251/366; 123/188.3, 188.2
See application file for complete search history.

(56) References Cited

U.S. PATENT DOCUMENTS 1,343,111 A * 6/1920 Cattaneo ..... 123/41.41
1,727,621 A 9/1929 Taub
2,371,548 A * 3/1945 Saffady ..... 123/188.3
2,398,514 A 4/1946 Bronander
4,164,957 A * 8/1979 Goloff ..... 123/188.3
5,458,314 A * 10/1995 Bonesteel ..... 123/188.3
6,006,713 A 12/1999 Gebauer et al.
6,308,675 B1 * 10/2001 Keller et al. ..... 123/188.3

(Continued)

FOREIGN PATENT DOCUMENTS

DE 36 25 590 A1 2/1988

(Continued)

*Primary Examiner*—John Bastianelli
(74) *Attorney, Agent, or Firm*—Collard & Roe, P.C.

(57) ABSTRACT

The invention relates to a gas exchange valve for an internal combustion engine, in each case comprising in particular a hollow valve stem (3) and valve head, in which the valve head comprises a valve bottom and a hollow valve keeper, connected to the external margin of the valve bottom, wherein the valve keeper tapers off as the distance from the bottom increases; the valve stem passes through the hollow valve keeper and is firmly connected to the valve bottom on the one hand, and to the tapering-off end of the valve keeper on the other hand; and the end of the valve stem which is connected to the valve bottom protrudes beyond the connection plane between the valve keeper and the valve bottom, is to be improved in relation to its stability and fatigue strength. For this purpose, the valve bottom of such a gas exchange valve comprises, in the annular region, which is situated between its connection to the valve stem on the one hand and to the valve keeper on the other hand, radially adjacent thereto at least one annular rib with an outwardly convex cross-sectional area.

9 Claims, 2 Drawing Sheets

U.S. PATENT DOCUMENTS

| | | | | |
|---|---|---|---|---|
| 6,354,258 | B1 * | 3/2002 | Abele et al. | 251/356 |
| 6,935,296 | B2 * | 8/2005 | Abele et al. | 123/188.3 |
| 2003/0121488 | A1 | 7/2003 | Abele et al. | |

FOREIGN PATENT DOCUMENTS

| | | | |
|---|---|---|---|
| DE | 198 04 053 | | 8/1999 |
| DE | 102 04 122 | | 5/2003 |
| DE | 102 17 719 | A1 | 11/2003 |
| DE | 10257505 | | 11/2003 |
| EP | 0 369 967 | A | 5/1990 |
| GB | 471 605 | A | 9/1937 |
| WO | WO 98/36 159 | A1 | 8/1998 |
| WO | WO99/16295 | | 4/1999 |

* cited by examiner

GAS EXCHANGE VALVE FOR AN INTERNAL COMBUSTION ENGINE

CROSS REFERENCE TO RELATED APPLICATIONS

Applicants claim priority under 35 U.S.C. §119 of German Application No. 102 0004010309.7 filed Mar. 3, 2004. Applicants also claim priority under 35 U.S.C. §365 of PCT/DE2005/000179 filed Feb. 4, 2005. The international application under PCT article 21(2) was not published in English.

BACKGROUND OF THE INVENTION

1. Field of the Invention

The invention relates to a gas exchange valve for an internal combustion engine.

2. Prior Art

Such gas exchange valves are for example known from WO99/16295 and U.S. Pat. No. 2,398,514.

SUMMARY OF THE INVENTION

The invention deals with the object of minimising the loads experienced on the valve head, in particular the bottom region of said valve head, as a result of temperature and combustion chamber pressure, with such minimising being achieved in particular by an optimised head geometry in particular in its bottom region, while at the same time keeping the walls as thin as possible. In this arrangement, in particular the overall deformation of the valve is to be kept in mind, namely with a view not only to displacement of the valve stem, but also to the deformation, as a result of combustion chamber pressure, of the valve bottom between the support in the centre of the bottom and the outer bottom region.

This object is primarily met by the design of a generic gas exchange valve as shown and described herein.

Advantageous and expedient embodiments of the invention are also shown and described.

The invention is based on the general idea of reinforcing the valve bottom in an overall convex outward stamped shape by annular rib regions which surround the valve axis, with a convex outward extending rib cross section. In this arrangement a single such annular rib, which can also be referred to as a toroidal section, between the inner support on the valve stem and the outer connection on the valve keeper may be adequate. Depending on the size of the valve head, several annular ribs, arranged concentrically in relation to each other within the valve bottom, can be provided. Furthermore, the central region of the valve bottom can be of convex or concave shape towards the outside if it adjoins a hollow valve stem. If the valve is made from metal, as a rule the individual elements of the gas exchange valve according to the invention are welded together.

The term "valve keeper" as commonly used in practical application denotes a "keeper" not of conical shape in the strictly mathematical sense but instead any funnel shape.

In a particularly advantageous embodiment the valve bottom connects to the valve keeper by way of a connecting collar. Connection is such that the radially outward margin areas of the valve bottom not only in the form of the connecting collar but also of the valve keeper are positioned in a connection surface which is formed by the generated surface of an imaginary cone, situated on the valve axis, with an equally positioned taper in relation to the valve keeper, wherein said radially outward margin areas of the valve bottom in this conical surface jointly taper off in the direction of the cone base area.

By way of such a margin design or connection design of the valve, in addition to the improved valve bottom stability achieved in this way, in particular the surrounding flow characteristics in the outer region of the valve bottom are improved. This design also achieves an improvement in relation to machining and the general component characteristics. Designing the joining region between the valve head and the valve bottom with a connection region of the type described above is favourable irrespective of the radially inward connecting design of the valve bottom, i.e. in principle it is equally favourable irrespective of the shape of the valve bottom.

The cone angle, formed by the generated surface of the imaginary cone relative to the base surface of said cone, can be $180°-\alpha$, wherein $\alpha=15°$ to $45°$, in particular $15°$ to $35°$.

Advantageous embodiments of the invention, explained in more detail below, are shown in the drawing.

BRIEF DESCRIPTION OF THE DRAWINGS

The drawing shows longitudinal cross sections of hollow valve heads with, according to FIG. 1 a valve bottom reinforced by a single annular rib.

DETAILED DESCRIPTION ON THE INVENTION

In the embodiments shown, the individual construction elements of the valve head are made of metal and are welded together, without the weld seams being shown as such.

Figure 1:
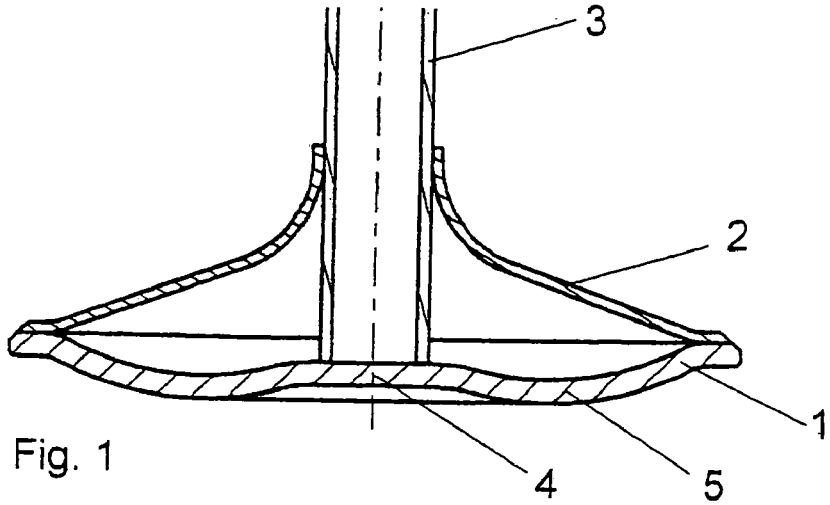

As is the case with all embodiments in the drawing, the valve head of FIG. 1 according to the invention comprises a valve bottom 1, a hollow valve keeper 2 and a hollow valve stem 3. The valve bottom 1 is welded not only to the hollow-cylindrically seated valve stem 3 but also to the external margin of the valve keeper 2. Moreover, the tapered off end of the valve keeper 2 is welded to the valve stem 3. The interconnected components mentioned above together form a rigid load bearing structure of the rotational plane. The valve bottom 1 comprises a largely plane central region 4 in the centre of the bottom. The annular region situated between this central region 4 and the external margin of the valve bottom 1 is an annular rib 5, which can also be referred to as a toroidal section, with an outwardly convex curvature. With such a design and optimisation of this shape, the cumulative load experienced as a result of temperature and peak combustion chamber pressure can be minimised, and the load can be reduced by evening out the local load maximums.

Figure 2:
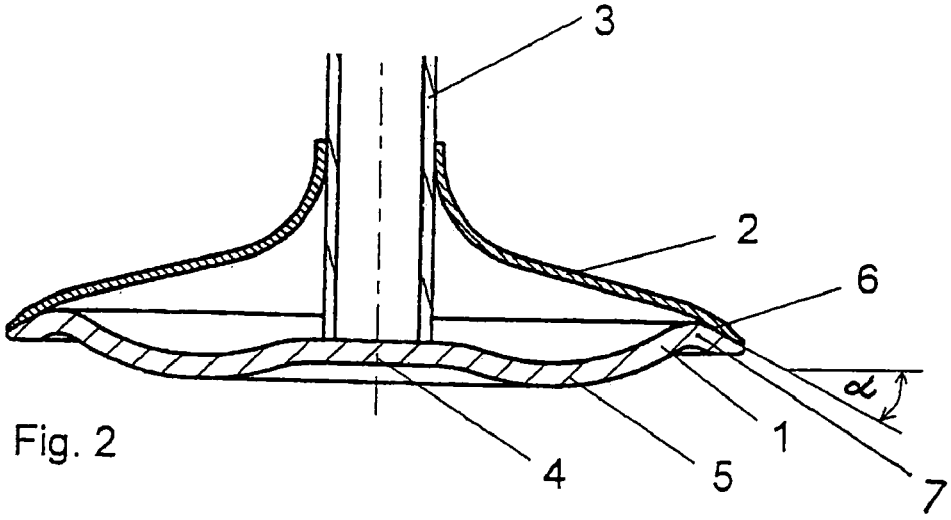
FIG. 2 a valve bottom according to FIG. 1, with a radially outward positioned connecting collar.

In the valve according to FIG. 2, in addition a connecting collar 7 is formed between the annular rib 5 and a radially outward located joining region 6 between the valve bottom 1 and the valve keeper 2.

The connecting collar 7 adjoins the valve keeper 2 in a connection surface which is formed by the generated surface of an imaginary cone, situated on the valve axis, with an equally positioned taper in relation to the valve keeper 2.

The connecting collar 7 and the adjoining margin area of the valve keeper 2 jointly taper off in this conical surface in the direction of the cone base area. The cone angle, formed by the generated surface of the imaginary cone relative to the base surface of said cone, is preferably 180°−α, wherein α=15° to 35°.

Figure 3:
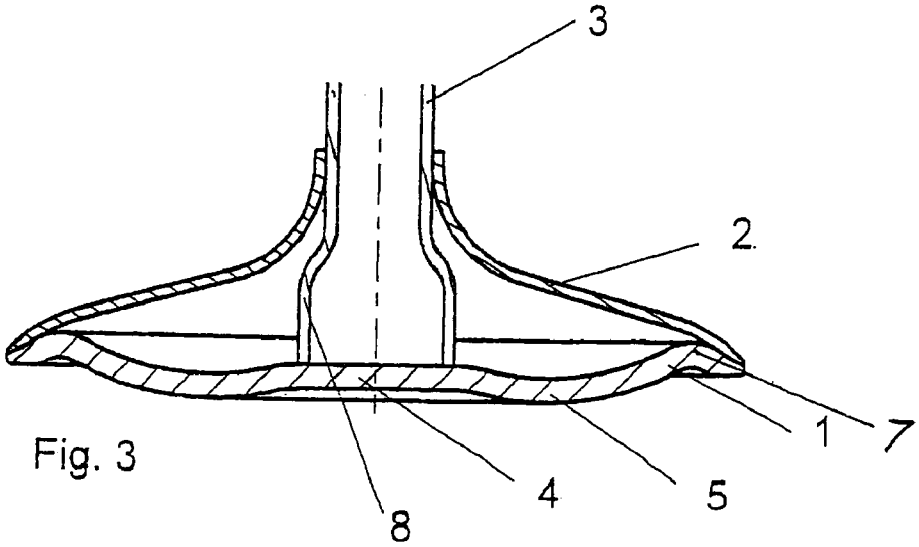
FIG. 3 a valve bottom according to FIG. 2, with a valve stem that has been widened within the valve head.

In a way that is different from the embodiment according to FIG. 2, in the valve embodiment according to FIG. 3 a valve stem 3 is used which has a region 8 that is widened in the interior of the valve. By means of this widened region 8 improved support of the valve bottom 1 in the latter's central region is achieved.

Figure 4:
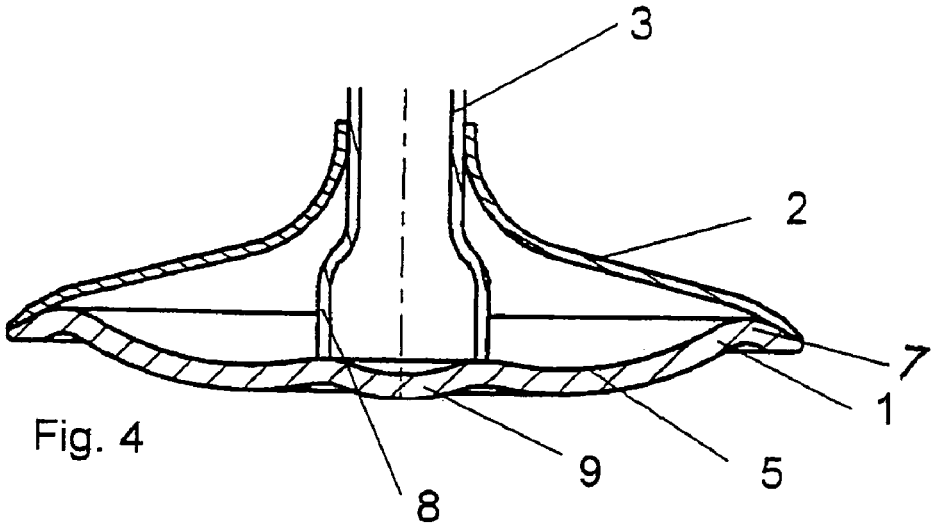
FIG. 4 a valve bottom according to FIG. 1, with an additional convex embodiment in the central region.

The valve embodiment according to FIG. 4 differs from that according to FIG. 3 only in that the valve bottom 1 within the widened region 8 of the valve stem 3 is curved outward in a convex shape in a central region 9.

Figure 5:
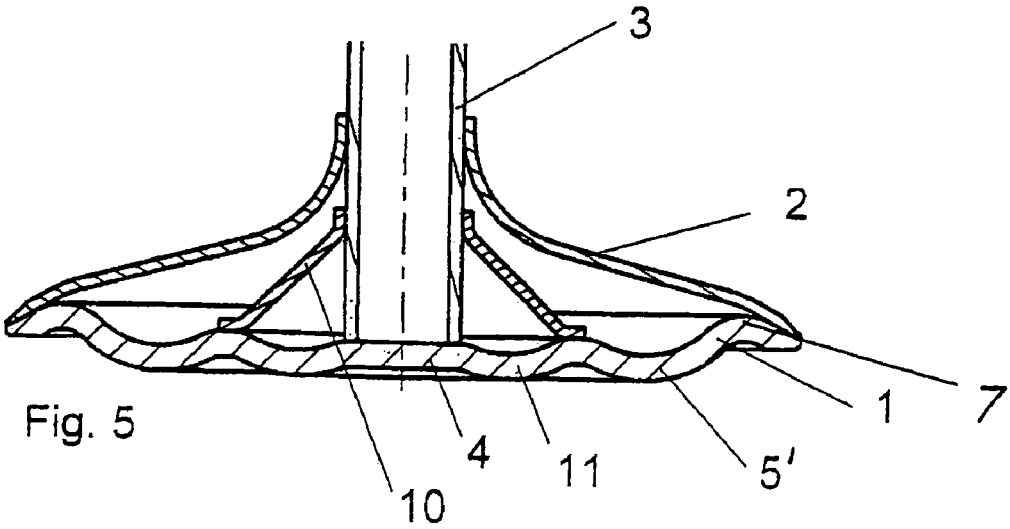
FIG. 5 a valve bottom in a basic shape according to FIG. 2, with an additional annular rib and a support cone within the valve head.

The embodiment according to FIG. 5 is based on a basic valve shape according to FIG. 2. In a way that is different to the embodiment according to FIG. 2, a support cone 10 is provided in the interior of the valve keeper 2. In its tapered-off region, this support cone 10 is welded to the valve stem 3. The support cone 10 is also welded to the valve bottom 1. The region in which the support cone 10 is welded to the valve bottom 1 is situated between annular ribs 5' and 11, formed in the valve bottom 1 so as to be concentric in relation to each other, with both of said annular ribs 5' and 11 having a convex outward extending cross section. The valve bottom comprising two annular ribs 5', 11, arranged concentrically in relation to each other, provides particularly good stability.

All the characteristics presented in the description and in the following claims can be significant in the context of the invention both individually and together in any desired form.

The invention claimed is:

1. A gas exchange valve for an internal combustion engine, comprising: a hollow valve stem and a valve head; in which the valve head comprises a valve bottom and a hollow valve keeper, connected to the external margin of said valve bottom, wherein the valve keeper tapers off as the distance from the bottom increases;

the valve stem passes through the hollow valve keeper and is firmly connected to the valve bottom, and to the tapering-off end of the valve keeper; and the end of the valve stem which is connected to the valve bottom protrudes beyond the connection plane between the valve keeper and the valve bottom, wherein the valve bottom in an annular region, which is situated between its connection to the valve stem and to the valve keeper, radially adjacent comprises at least one annular rib with a cross-sectional area of the annular rib that extends so as to be convex towards the outside.

2. The gas exchange valve according to claim 1, wherein the diameter of the valve stem at its end connected to the valve bottom is larger than at its connection region to the valve keeper.

3. The gas exchange valve according to claim 1 comprising a hollow valve stem which rests against the valve bottom so as to be cylindrically open, wherein the valve bottom, within its region adjoining to the hollow space of the valve stem, is outwardly curved so as to be convex.

4. The gas exchange valve according to claim 1, wherein the valve bottom, within its region adjoining the hollow space of the valve stem, is curved from the outside to the inside so as to be concave.

5. The gas exchange valve according to claim 1, wherein within the valve keeper an inner support cone is provided with a connection to the valve bottom in a region between two radially adjoining valve-bottom annular ribs, and with a connection at its tapered off region to the valve stem.

6. The gas exchange valve according to claim 1, wherein the annular ribs comprise a cross section which is parabolic, hyperbolic or logarithmic in shape.

7. A gas exchange valve for an internal combustion engine, comprising: a valve stem and a valve head; in which the valve head comprises a valve bottom and a hollow valve keeper, connected to the external margin of said valve bottom, wherein the valve keeper tapers off as the distance from the valve bottom increases; and the valve stem passes through the hollow valve keeper and in each case is firmly connected to the valve bottom, and to the tapering-off end of the valve keeper, wherein the radially outward margin areas of the valve head not only in the form of the connecting collar but also of the valve keeper are positioned in a connection surface which is formed by the generated surface of an imaginary cone, situated on the valve axis, with an equally positioned taper in relation to the valve keeper, wherein said radially outward margin areas of the valve bottom in this conical surface jointly taper off in the direction of the cone base area.

8. The gas exchange valve according to claim 7, wherein the cone angle, formed by the generated surface of the imaginary cone relative to the base surface of said cone, is 180°−α, wherein α=15° to 45°.

9. The gas exchange valve according to claim 8, wherein the angle α is between 15° and 35°.

* * * * *